US006375140B1

(12) United States Patent
Shen

(10) Patent No.: US 6,375,140 B1
(45) Date of Patent: Apr. 23, 2002

(54) FASTENING DEVICE FOR A TOP ROD OF A WINDOW SHADE

(75) Inventor: Chang Han Shen, Chang Hua Hsien (TW)

(73) Assignee: Gee Mei Handicraft Company Limited, Chang Hua Hsien (TW)

( * ) Notice: Subject to any disclaimer, the term of this patent is extended or adjusted under 35 U.S.C. 154(b) by 0 days.

(21) Appl. No.: 09/736,784

(22) Filed: Dec. 15, 2000

(51) Int. Cl.[7] ..... A47H 1/10

(52) U.S. Cl. ..... 248/251; 248/262; 160/181; 160/368.1

(58) Field of Search ..... 248/251, 254, 248/261, 262, 266, 267, 268; 160/368.1, 181, 182, 174.1 R, 350, 380

(56) References Cited

U.S. PATENT DOCUMENTS 5,667,178 A * 9/1997 Yang ..... 248/262

6,322,029 B1 * 11/2001 Sonnenberg et al. ... 248/222.13

* cited by examiner

*Primary Examiner*—Leslie A. Braun
*Assistant Examiner*—Deborah M. Brann
(74) *Attorney, Agent, or Firm*—Harrison & Egbert

(57) ABSTRACT

A fastening device of a top rod of a window shade is formed of a locating seat and a pressing seat. The locating seat has a top plate and a back plate. The top plate is provided with a plurality of through holes, and a cross retaining rib. The back plate is provided with two L-shaped portions, a slide slot, a threaded rod, and a long slot hole. The pressing seat has a position confining plate which is provided with an edge retaining rib, a top retaining rib, and a slide frame plate. The slide frame plate is provided with a bolt pillar and a wing portion having a frame slide rib. The structural strength of the fastening device is reinforced by the L-shaped portions of the locating seat, the bolt pillar and the frame slide rib of the pressing seat.

1 Claim, 9 Drawing Sheets

FASTENING DEVICE FOR A TOP ROD OF A WINDOW SHADE

BACKGROUND OF THE INVENTION

1. Field of the Invention

The present invention relates generally to a window shade, and more particularly to a fastening device of the top rod of a window shade.

2. Description of Related Art

As shown in FIGS. 1–3, a prior art fastening device of a top rod of a window shade is formed of a locating seat 11 and a pressing seat 21. The locating seat 11 has a top plate 12 which is provided with a plurality of hanging frame holes 13 and a recessed portion 14. The locating seat 11 further has a back plate 15 extending from the top plate 12 and having two guide rails 16, a long slot hole 17, and a locating piece 18 which is provided with a threaded hole 19. The pressing seat 21 is provided at the bottom thereof with a position confining piece 22 having a folded edge 23 and a support plate 24. The support plate 24 is provided with two slide edges 25. The support plate 24 is further provided at the center with a press piece 26 having a support hole 27. A bolt 28 is engaged with the threaded hole 19 of the locating piece 18 via the support hole 27 of the press piece 26. As the pressing seat 21 is joined with the locating seat 11, the top rod of the window shade is held in the recessed portion 14 of the locating seat 11. In the meantime, the wood strip 3 of the window shade 2 is confined by the position confining piece 22. The fastening device is apt to deform when the window shade 2 is pulled.

As shown in FIGS. 4–6, another prior art fastening device of a top rod of a window shade, is formed of a locating seat 31 and a pressing seat 41. The locating seat 31 has a top plate 32 which is provided with a plurality of hanging frame holes 33, two folded edges 34, and a protruded plate 35. The locating seat 31 further has a back plate 36 which is provided with a folding frame plate 38 having an inner slide slot 37, a long slot hole 39, and a threaded tube 40. The pressing seat 41 has a position confining piece 42 having a slide frame plate 43, and a support hole 44. A bolt 45 is engaged with the threaded tube 40 via the support hole 44. The top rod of the window shade 1 is supported by the protruded plate 35 of the locating seat 31. In the meantime, the wood strip 3 of the window shade 2 is confined by the position confining piece 42 of the pressing seat 41. The position confining piece 42 and the folding frame 38 are susceptible to deformation.

BRIEF SUMMARY OF THE INVENTION

The primary objective of the present invention is to provide a fastening device of a top rod of a window shade, which is formed of a locating seat and a pressing seat. The locating seat is joined with the pressing seat to accommodate the top rods of window shades of various types.

The features and the functions of the present invention will be more readily understood upon a thoughtful deliberation of the following detailed description of the present invention with reference to the accompanying drawings.

DETAILED DESCRIPTION OF THE INVENTION

Figure 1:
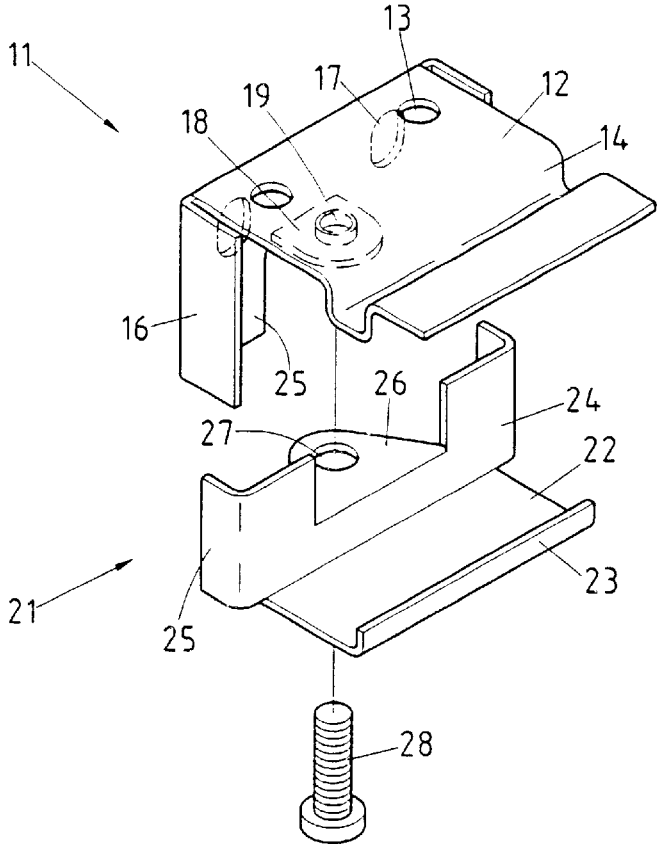
FIG.1 PRIOR ART
FIG. 1 shows an exploded view of a prior art device.
Figure 2:
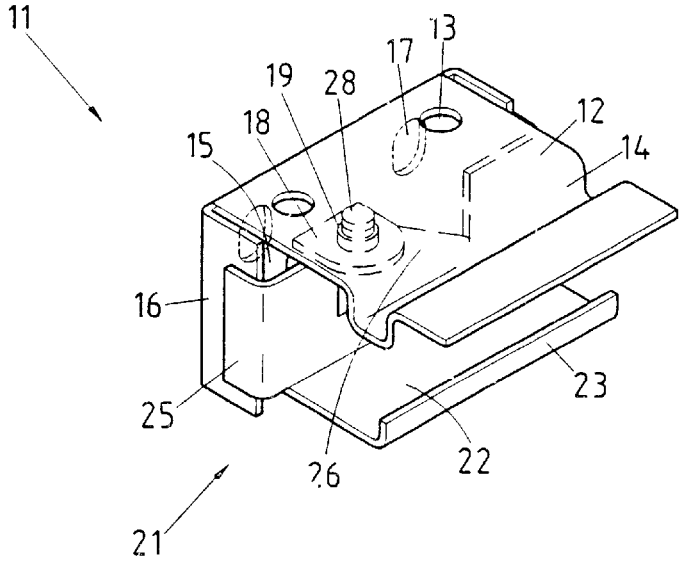
FIG.2 PRIOR ART
FIG. 2 shows a perspective view of the prior art device.
Figure 3:
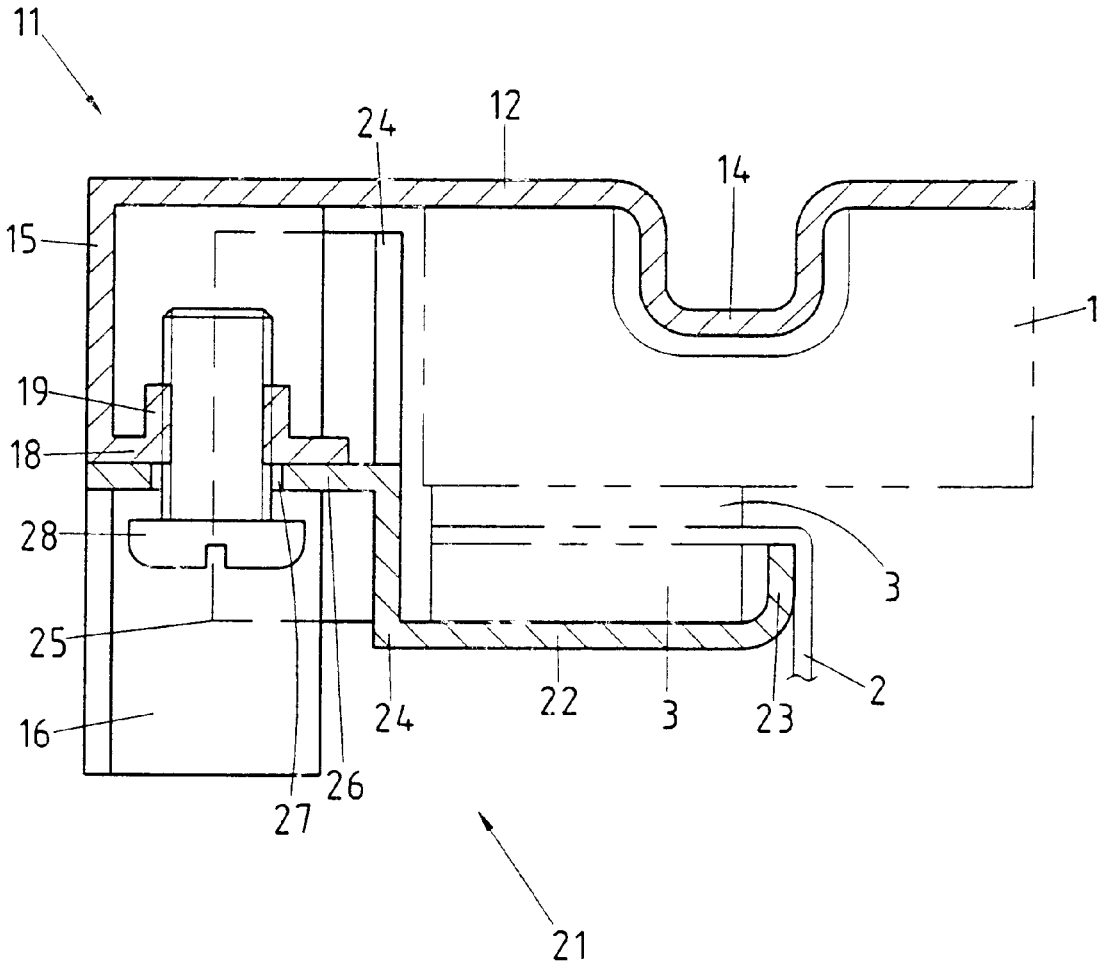
FIG. 3 PRIOR ART
FIG. 3 shows a schematic view of the prior art device in use.
Figure 4:
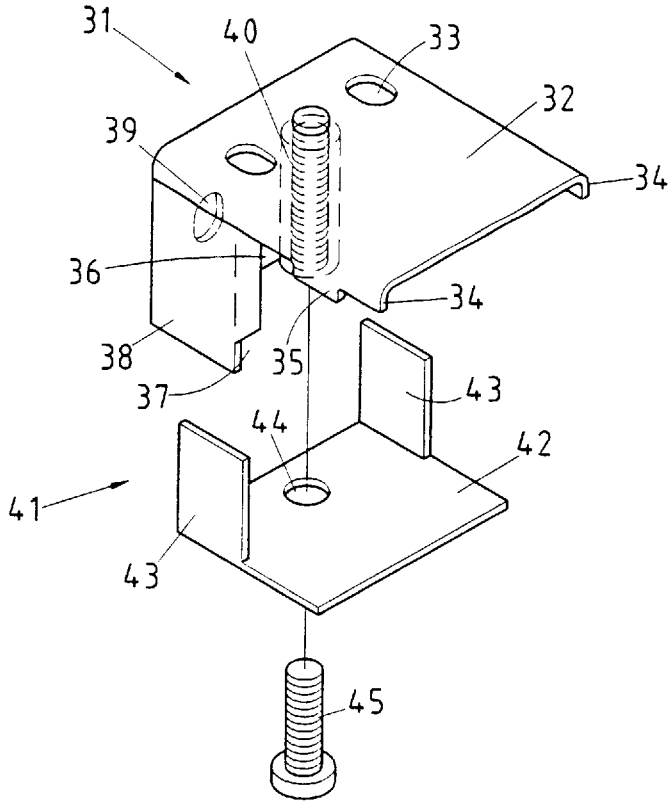
FIG.4 PRIOR ART
FIG. 4 shows an exploded view of a second prior art device.
Figure 5:
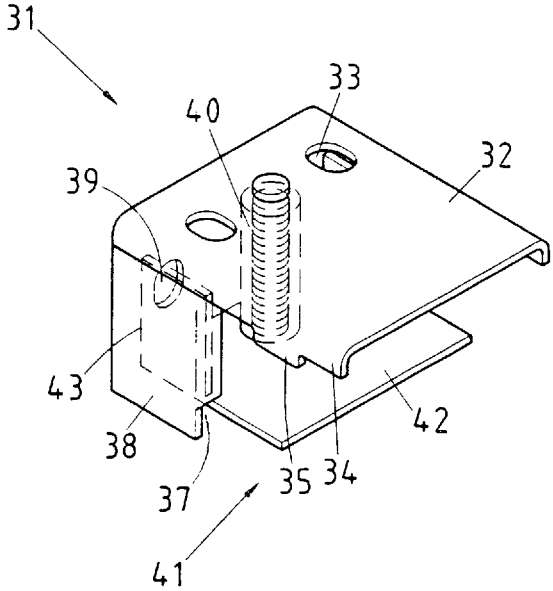
FIG.5 PRIOR ART
FIG. 5 shows a perspective view of the second prior art device.
Figure 6:
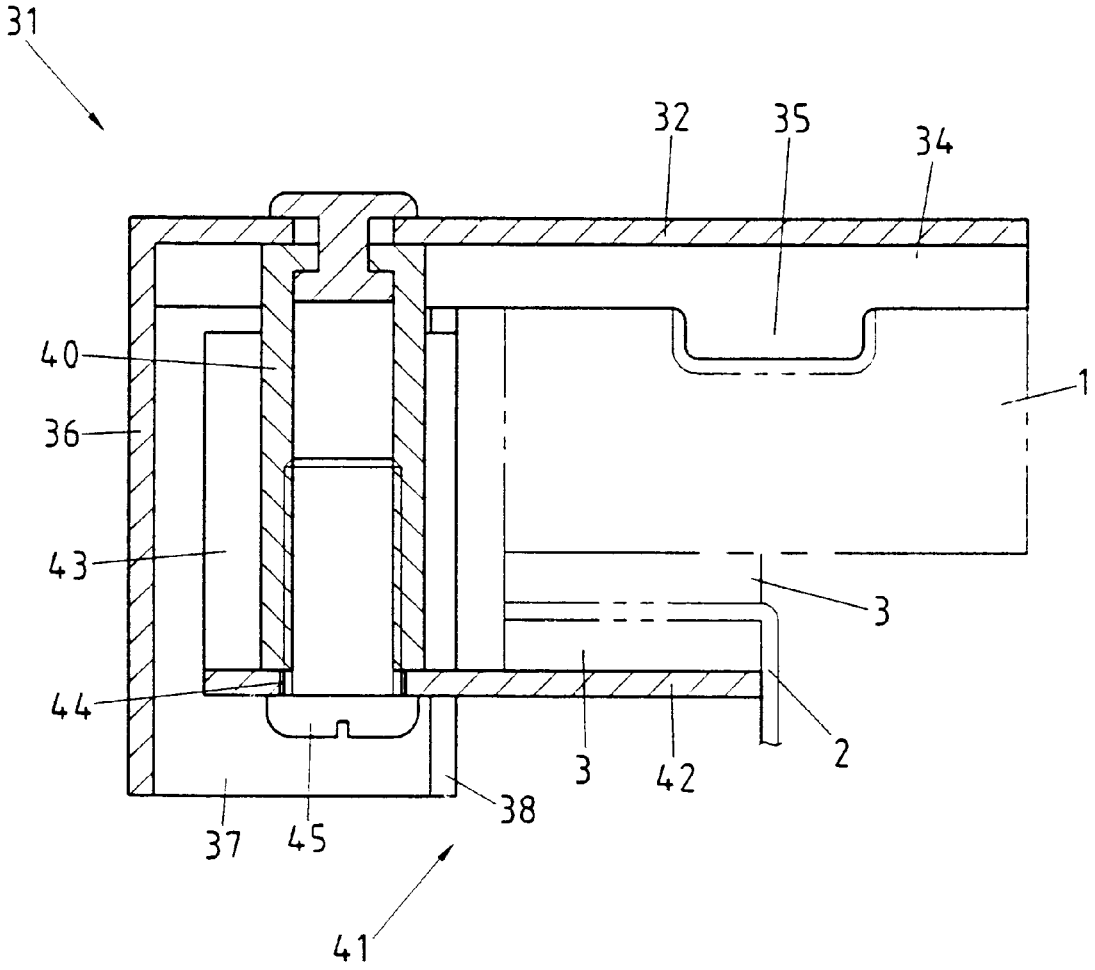
FIG.6 PRIOR ART
FIG. 6 shows a schematic view of the second prior art device in use.
Figure 7:
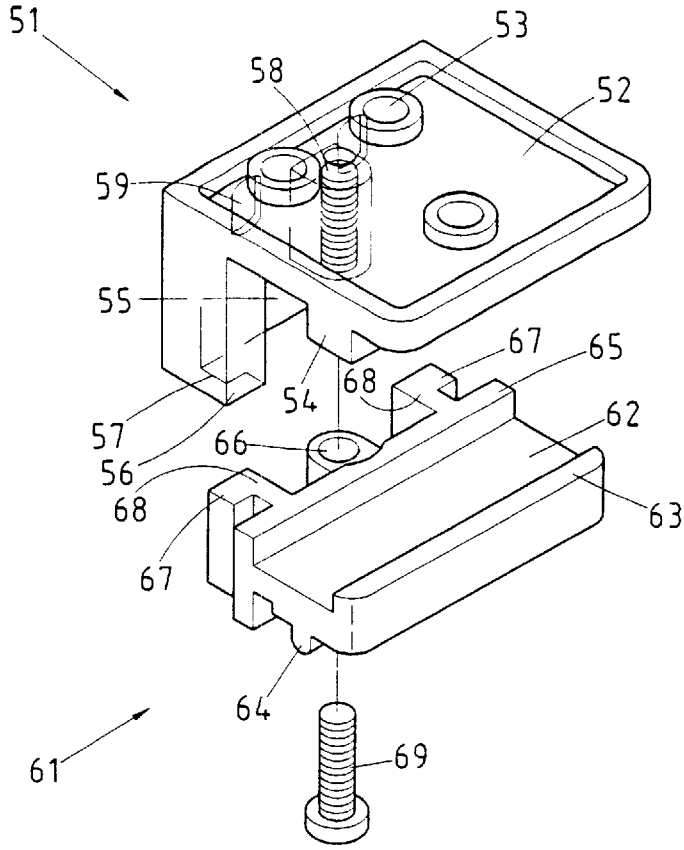
FIG. 7 shows an exploded view of the present invention.
Figure 8:
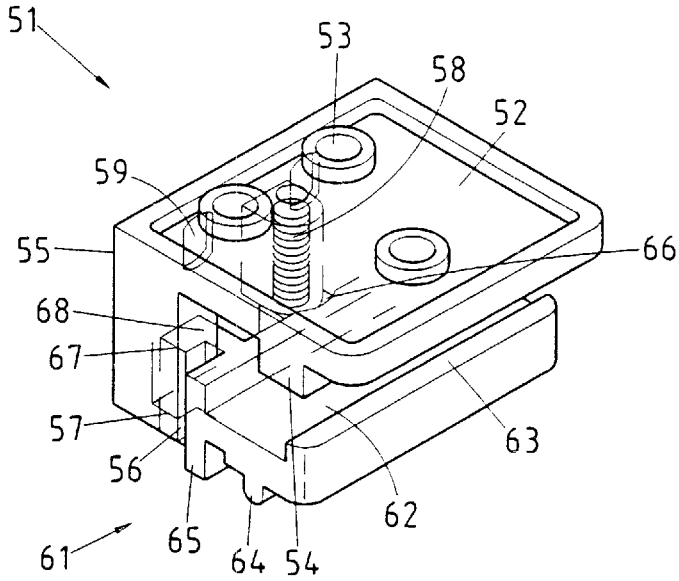
FIG. 8 shows a perspective view of the present invention.
Figure 9:
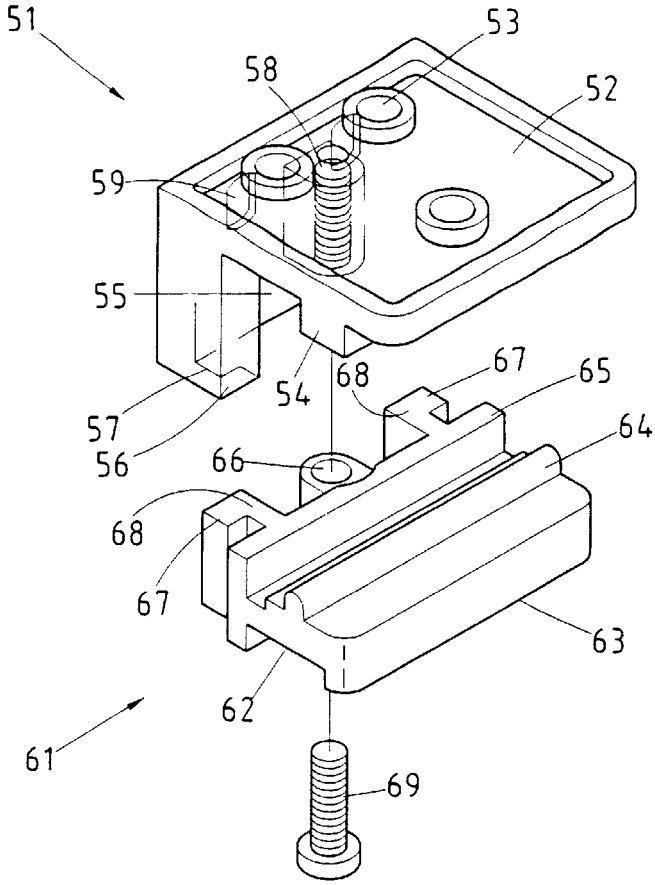
FIG. 9 shows another exploded view of the present invention.
Figure 10:
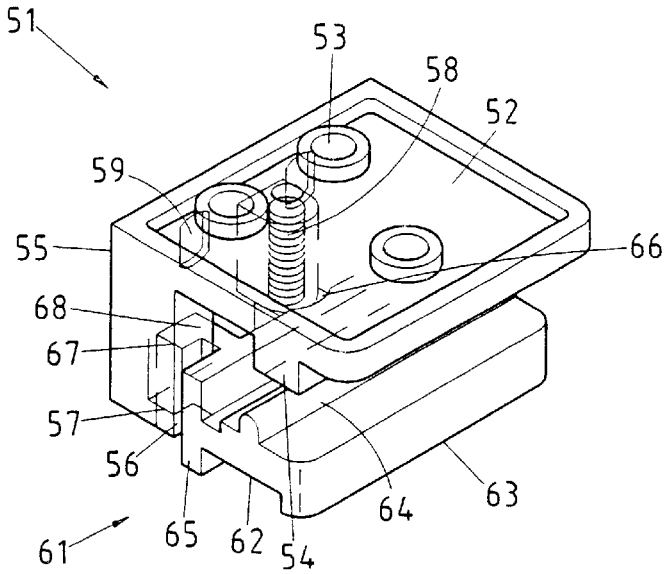
FIG. 10 shows another perspective view of the present invention.
Figure 11:
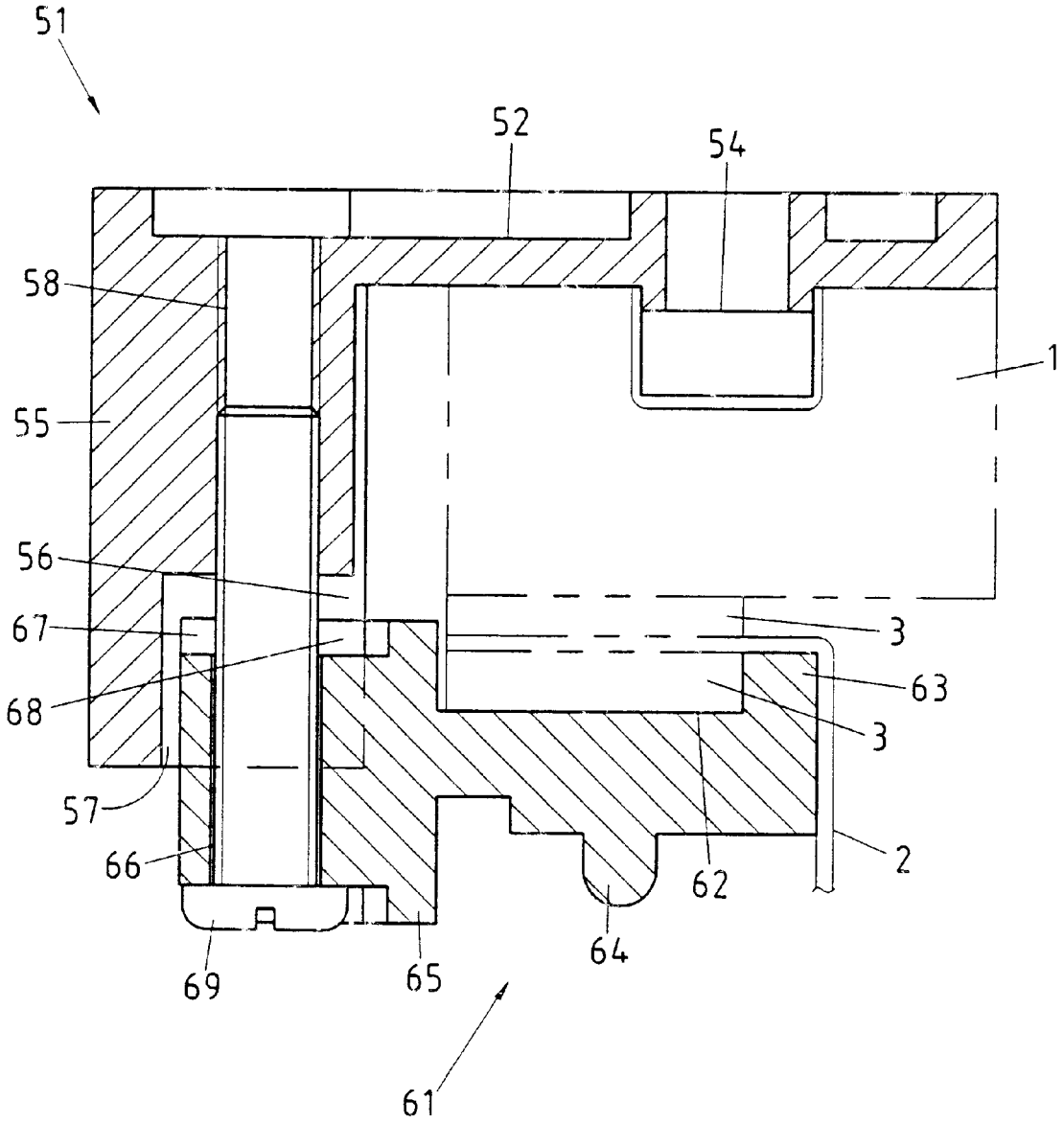
FIG. 11 shows a schematic view of the present invention in use.
Figure 12:
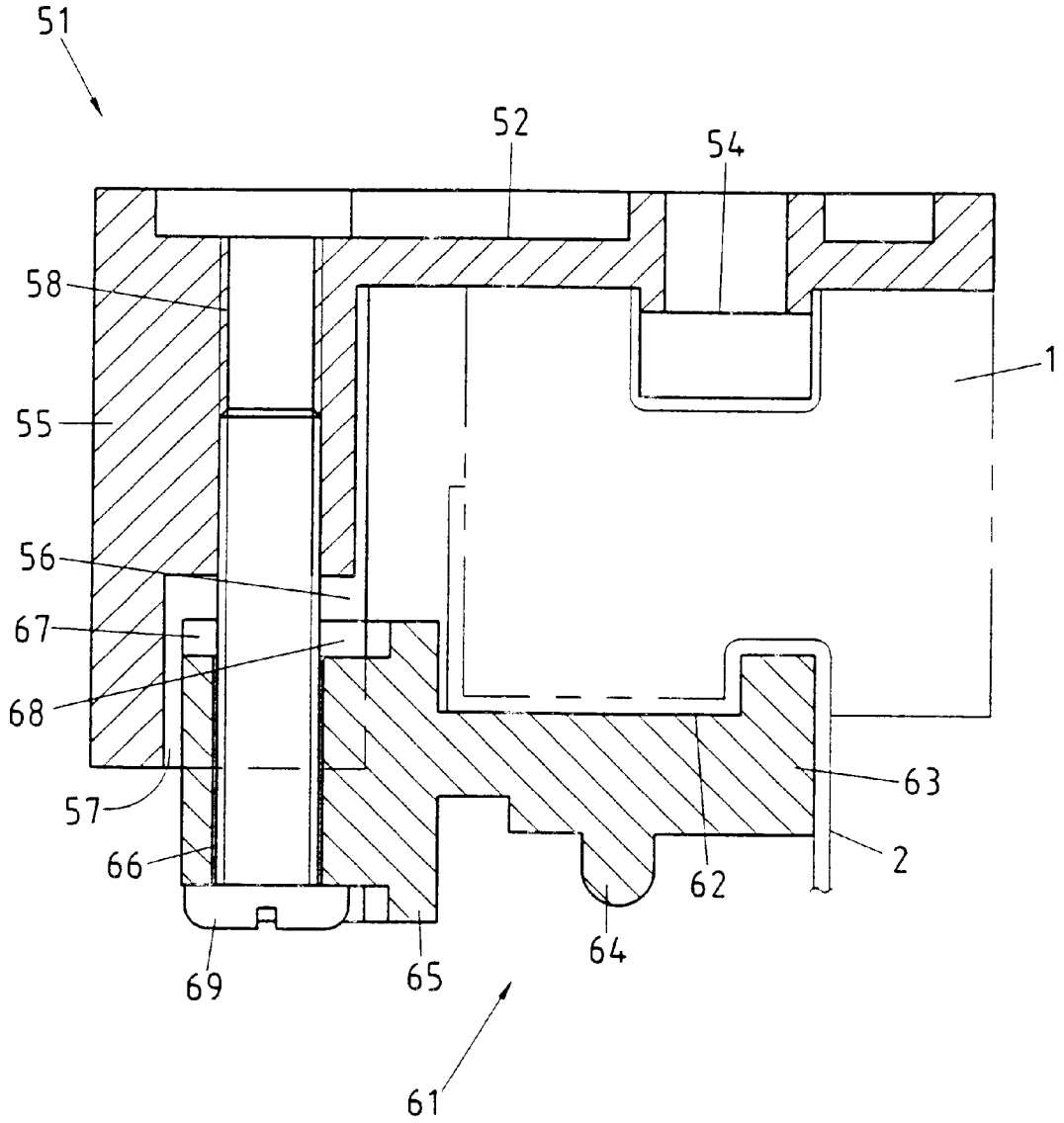
FIG. 12 shows another schematic view of the present invention in use.
Figure 13:
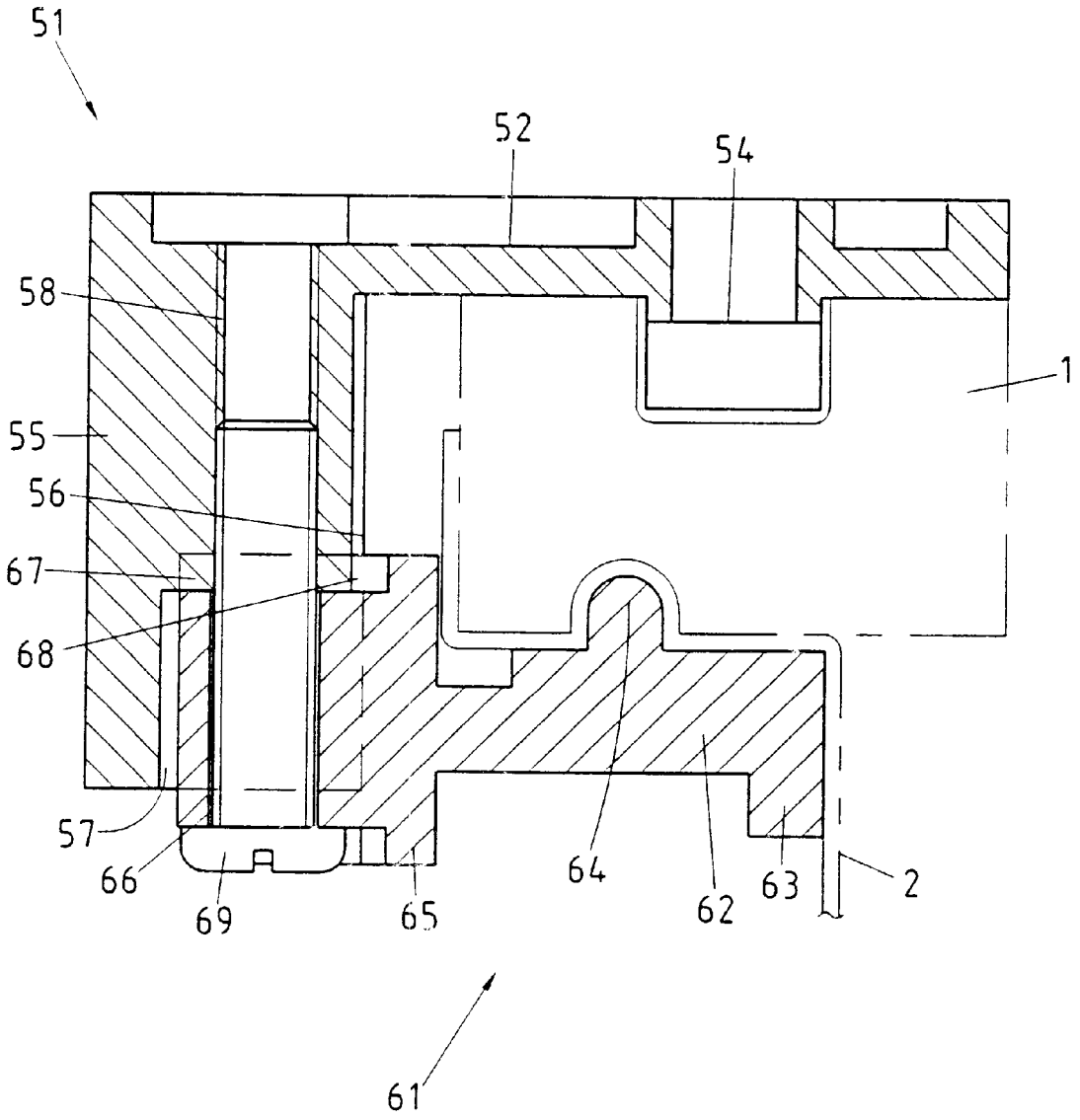
FIG. 13 shows still another schematic view of the present invention in use.

As shown in FIGS. 7–13, a fastening device embodied in the present invention is intended to fasten a top rod 1 of a window shade 2 and is formed of a locating seat 51 and a pressing seat 61.

The locating seat 51 has a top plate 52, which is provided with a plurality of through holes 53 and a cross retaining rib 54. The locating seat 51 further has a back plate 55, which is provided with two L-shaped portions 56 opposite to each other to form a slide slot 57. The back plate 55 is further provided with a threaded rod 58 and a long slot hole 59.

The pressing seat 61 has a position confining plate 62 which is provided with an edge retaining rib 63, a top retaining rib 64, and a slide frame plate 65 which is provided in the center of the back side with an upright bolt pillar 66, and provided in two sides with a wing portion 68 having a frame slide rib 67.

The locating seat 51 and the pressing seat 61 are joined together such that the frame slide rib 67 of the wing portion 68 of the pressing seat 61 is slidably disposed in the slide slot 57 of the L-shaped portions 56, and that such edge retaining rib 63 and the top retaining rib 64 of the position confining plate 62 can be selectively turned over, and also such that a bolt 69 is put through the bolt pillar 66 to fasten to the threaded rod 58. The locating seat 51 and the pressing seat 61 are joined together to fasten the window shade top rod 1 or a wooden strip 3 holding the window shade 2.

The structural strength of the fastening device of the present invention is reinforced by the L-shaped portions 56 of the locating seat 51 and the bolt pillar 66 of the slide frame plate 65 of the pressing seat 61, as well as the frame slide rib 67 of the wing portion 68 of the slide frame plate 65 of the pressing seat 61.

I claim:

1. A fastening device of a top rod of a window shade, comprising:

a locating seat having a top plate and a back plate, said top plate being provided with a plurality of through holes, and a cross retaining rib, said back plate being provided with two L-shaped portions, a slide slot, a threaded rod, and a long slot hole; and a pressing seat having a position confining plate, said position confining plate being provided with an edge retaining rib, a top retaining rib, and a slide frame plate whereby said slide plate is provided in the center of a back side thereof with an upright bolt pillar, and in two sides thereof with a wing portion having a frame slide rib;

wherein said locating seat and said pressing seat being joined together to fasten the top rod of the window shade such that said frame slide rib of said wing portion of said pressing seat is slidably disposed in said slide slot of said locating seat, and that said edge retaining rib and said top retaining rib of said position confining plate of said pressing seat can be selectively turned over, and further that a bolt is put through said bolt pillar of said slide frame plate of said position confining plate of said pressing seat, so as to fasten to said threaded rod of said back plate of said locating seat.

* * * * *